US005284081A

United States Patent [19]

Stoner et al.

[11] Patent Number: 5,284,081

[45] Date of Patent: Feb. 8, 1994

[54] LIGHTWEIGHT GRENADE LAUNCHER

[75] Inventors: Eugene M. Stoner, Palm City, Fla.; Seth Bredbury, Biddeford, Me.; John Wilson, Dover, N.H.

[73] Assignee: Saco Defense Inc., Saco, Me.

[21] Appl. No.: 970,819

[22] Filed: Nov. 3, 1992

[51] Int. Cl.[5] ..... F41A 9/02

[52] U.S. Cl. ..... 89/33.17; 89/33.03; 89/168; 89/175; 89/176; 42/105

[58] Field of Search ..... 89/33.16, 33.17, 33.25, 89/168, 169, 175, 176, 33.03; 42/105

[56] References Cited

U.S. PATENT DOCUMENTS

| | | | |
|---|---|---|---|
| 459,828 | 9/1891 | Maxim | 89/33.25 |
| 1,091,638 | 3/1914 | Dawson et al. | 89/33.17 |
| 1,128,310 | 2/1915 | Heinemann | 89/175 |
| 1,518,498 | 12/1924 | Furrer | 89/175 |
| 2,555,379 | 6/1951 | Simpson | 89/33.25 |
| 3,000,267 | 9/1961 | Robinson | 89/169 |

FOREIGN PATENT DOCUMENTS

| | | | |
|---|---|---|---|
| 66152 | 6/1913 | Switzerland | 89/175 |

*Primary Examiner*—Stephen M. Johnson
*Attorney, Agent, or Firm*—William Nitkin

[57] ABSTRACT

A lightweight grenade launcher utilizing a rotary feed mechanism in conjunction with a toggle link bolt movement mechanism to incorporate the barrel, flash suppressor, bolt and toggle link mechanism as part of the gun's recoiling mass with the barrel moving during recoil and counter recoil through a center aperture in the rotary sprocket of the feed mechanism.

5 Claims, 5 Drawing Sheets

LIGHTWEIGHT GRENADE LAUNCHER

BACKGROUND OF THE INVENTION

1. Field of the Invention

The device of this invention resides in the field of guns and more particularly relates to a lightweight, self-powered, short recoil-operated 40 mm machine gun for the launching of grenades.

2. Description of the Prior Art 40 mm machine guns for launching grenades exist in the prior art, but they are heavy guns with recoiling masses that are a small percentage of their total weight. These heavy guns must be supported by several personnel, and high trunnion forces require that the gun must be securely mounted. The current state-of-the-art MK19 40 mm gun has a 17 lb bolt and an assembly weight of 71 lbs. Therefore the recoiling mass of the MK19 represents only 24% of its assembly weight.

SUMMARY OF THE INVENTION

It is an object of this invention to provide an improved grenade launcher in a short recoil-operated machine gun.

It is a further object of this invention to provide a machine gun that is extremely lightweight and manportable.

It is a still further object of this invention to maximize the gun's recoiling mass as a percentage of the overall gun mass. The recoiling mass in a grenade launcher is defined as the mass of those gun components that are set into motion as a direct but opposite result of the gas pressure acting to push the projectile down the length of the barrel. Once the recoiling mass is in motion, it must eventually be arrested and its kinetic energy absorbed by the non-recoiling mass. In prior art guns the non-recoiling mass consists of the mass of the gun receiver, charger system, mount system, and to some extent the gunner. The rationale for the desired maximization of the recoiling mass utilizes the First Law of Conservation of Momemtum: $M_1V_1=M_2V_2$ which Law indicates that the mass $M_1 \times V_1$ of the 40 mm projectile as it exits the barrel muzzle is equal to the total mass $M_2 \times V_2$ of the recoiling mass. Therefore from this formula if the recoiling mass is increased, its velocity will decrease. The greater the kinetic energy KE of the gun's recoiling mass, the greater the force required to maintain control of the gun. The total KE of the recoiling mass is expressed by the following equation: $KE=(\frac{1}{2})M_2V_2^2$. This relationship states that one-half the square of the recoil velocity times the recoil mass equals its kinetic energy. The lightweight grenade launcher of this invention minimizes the recoil kinetic energy because the recoiling mass is maximized. Since momentum must be conserved, the recoiling velocity will decrease and a decrease in velocity will produce an exponential decrease in KE. The result is a lightweight grenade launcher that, if designed to fire existing 40 mm ammunition, allows for a gun assembly that is approximately one-half the mass of currently fielded technology such as the MK-19 40 mm grenade launcher.

In order to achieve the advantageous lightweight grenade launcher recoil weight:assembly weight proportion, a unique combination of two systems has been utilized. These two systems include a toggle link mechanism and a rotary feed mechanism. The rotary feed system provides a reliable, lightweight feed system having a minimum of moving parts. This lightweight feed system allows a higher percentage of the system weight to be included in the recoiling mass. The toggle link mechanism provides the means to include the barrel and flash suppressor as part of the recoiling mass. The barrel extension which comprises a major portion of the recoiling mass is the main strength element of the gun which means that the receiver, which is part of the non-recoiling mass, is less stressed and therefore can be lighter in weight in its construction. The following components comprise the recoiling mass of the lightweight grenade launcher of this invention: the flash suppressor, barrel, one-half the recoil spring mass, the barrel extension, the bolt assembly, the bolt link, the main link and the firing pin striker. These component parts together weigh approximately 20 lbs. Since the gun assembly weighs 35 lbs in total, the component parts represent 57% of the total gun weight and 40% of the gun and mount system. By having the recoiling mass be a higher percentage of the total weight of the assembly compared to that of the prior art, significant advantages are obtained. The 35 lb gun of this invention can be carried by a single infantry soldier. The gun can be deployed on a rigid mount but because of the minimized kinetic energy of the recoiling mass, the strength of the mount can also be reduced for additional weight savings. The result is a very desirable two man operable and portable 40 mm lightweight grenade launching system.

In operation, the barrel of the gun of this invention is rigidly attached to the barrel extension and during the firing cycle this assembly moves along the center axis of the gun a distance of approximately 3 inches, being approximately 3 inches in recoil and approximately 3 inches in counter-recoil. The feed sprocket rotates in a plane orthogonal to the center axis of the gun and is powered by the energy of the recoiling mass. The feed sprocket has cam followers that engage into cam paths in the barrel extension. As the barrel extension cycles, the feed sprocket is made to rotate by the movement of the cam followers in the cam paths. In one complete gun cycle the sprocket must rotate 45 degrees being 24 degrees in recoil and 21 degrees in counter recoil. When a cartridge which is positioned within one of the openings of the feed sprocket is rotated to the top of the sprocket by the rotating action of the sprocket at each firing and such cartridge is in the uppermost ready position when the bolt comes into battery, the extractor on the bolt engages the rear rim of the ready cartridge. The cartridge is extracted from the sprocket opening as the bolt accelerates away from battery. As the bolt travels in recoil, a feed lever which is part of the bolt assembly drives the cartridge down and in line with the gun chamber. This action simultaneously pushes the spent case out the bottom of the gun. On the counter-recoil stroke the cartridge is chambered, and if the trigger is depressed, the firing pin striker is then released, firing the grenade, and the entire cycle is repeated.

The advantage of using the toggle link mechanism is that it creates a highly desirable motion of the bolt relative to the barrel extension and chamber. From the battery position the cartridge impulse gives the entire recoiling mass an initial velocity. The impulse is transmitted to the barrel extension through the bolt link, to the main link and finally to the main link pivot. The main link pivot is pivotally anchored in the barrel extension. As the recoiling mass moves rearward, the stationary pivot of the control link retains the bottom of the control link in position, causing it to rotate approximately 90 degrees about the stationary pivot. This rotation, in turn, rotates the rear of the main link downwards, causing it to pivot at the main link pivot and raise the rear of the bolt link, causing the front of the bolt link to pull the bolt pivotally attached to the front of the bolt link rearward. This action causes the bolt to accelerate away from the breach and travel over a greater distance than the movement of the barrel extension itself. Once the bolt is in its rearmost position, the compressed recoil spring on the front of the barrel by its counter-recoil pressure pulls the barrel and interconnected bolt forward again.

DESCRIPTION OF THE PREFERRED EMBODIMENT(S)

Figure 1:
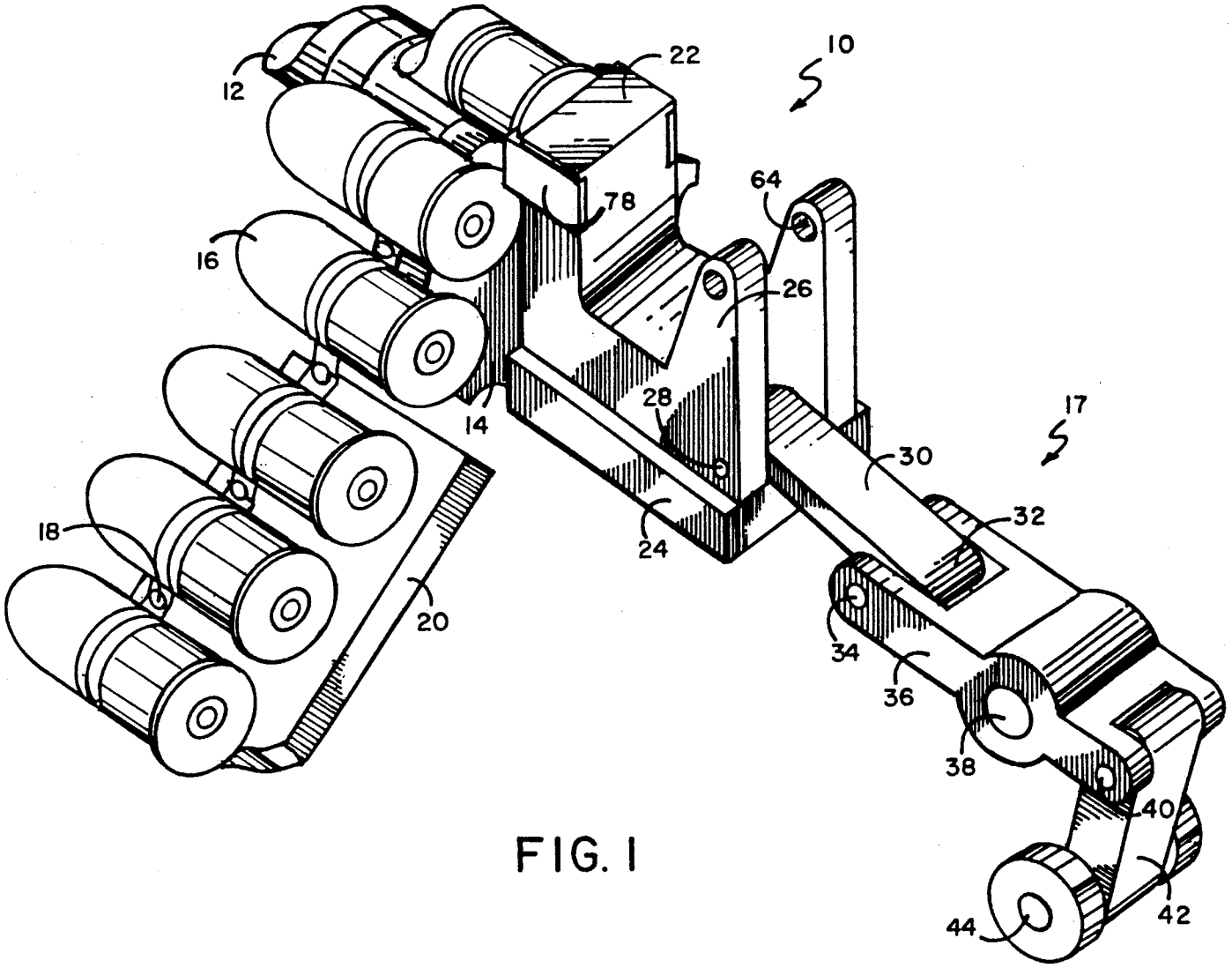
FIG. 1 illustrates a perspective view of the combined toggle link mechanism and feed sprocket mechanism of the gun of this invention.
Figure 9:
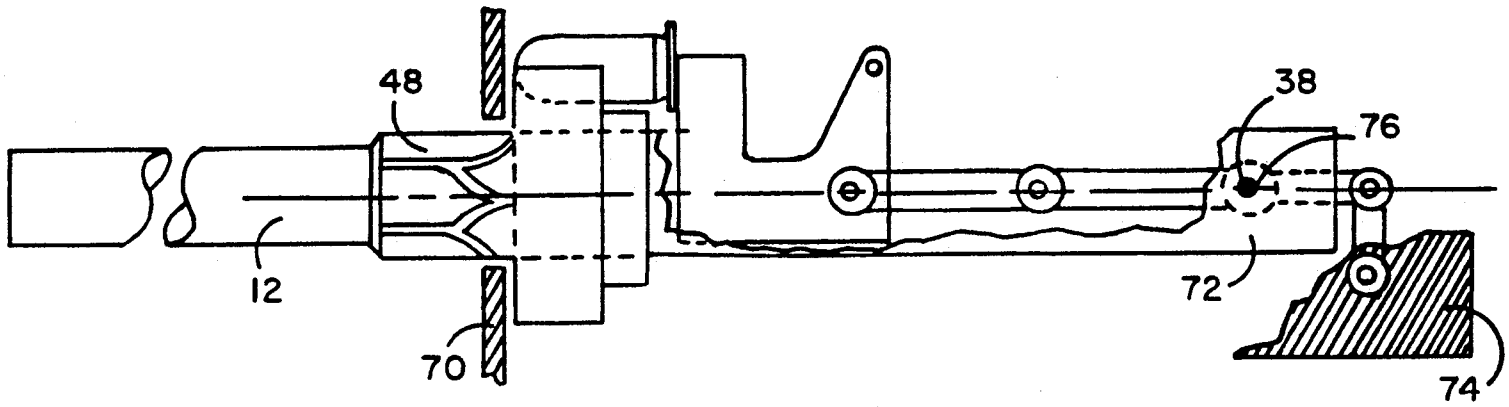
FIG. 9 illustrates a cutaway view of the barrel extension showing the position of the main link pivot and the bolt in its foremost firing position, extracting a cartridge from the top opening of the sprocket.

FIG. 1 illustrates a perspective view of the two basic combined systems of the device of this invention. Not shown in this view is the receiver. The first system includes feed sprocket 14 which has eight rounded openings around its periphery into which openings cartridges 16, held in a belt, are fed in sequence. Cartridges 16 are 40 mm grenades and are interconnected together by releasable cartridge connectors 18 well known in the art. The cartridges pass up ramp 20 and are engaged one into each opening 15, seen in FIG. 2, of feed sprocket 14 where they are held. As feed sprocket 14 rotates clockwise, the cartridges are moved into the uppermost position to be picked up by extractor 78 on the sides of bolt 22. Barrel 12 is seen, but the chamber behind bolt 22 is not visible in this view as it is covered by bolt 22. Bolt 22 contains a firing pin also not seen in this view. The second system moves bolt 22 within barrel extension 48 on bolt slide 24. At the rear of bolt 22 extending upwards is feed lever support member 26 at the base of which is first bolt link pivot 28 which pivotally hinges bolt link 30 which, in turn, is pivotally attached to main link 36 by second bolt link pivot 34. Main link 36 and bolt link 30 can only pivot upwards and not downwards because control link 42 when in its vertical position will not allow any further rotation of bolt link 30 and main link 36. Main link 36 has extending therethrough main link pivot 38 which has its pivot shaft extending into both sides of the rear 72 of the barrel extension as seen in FIG. 9. At the rear of main link 36 is control link 42 which is pivotally attached to main link 36 by control link pivot 40. At the other end of control link 42 is stationary pivot 44 which pivotally holds the bottom of the control link in a fixed position in the rear 74 of the receiver housing.

Figure 2:
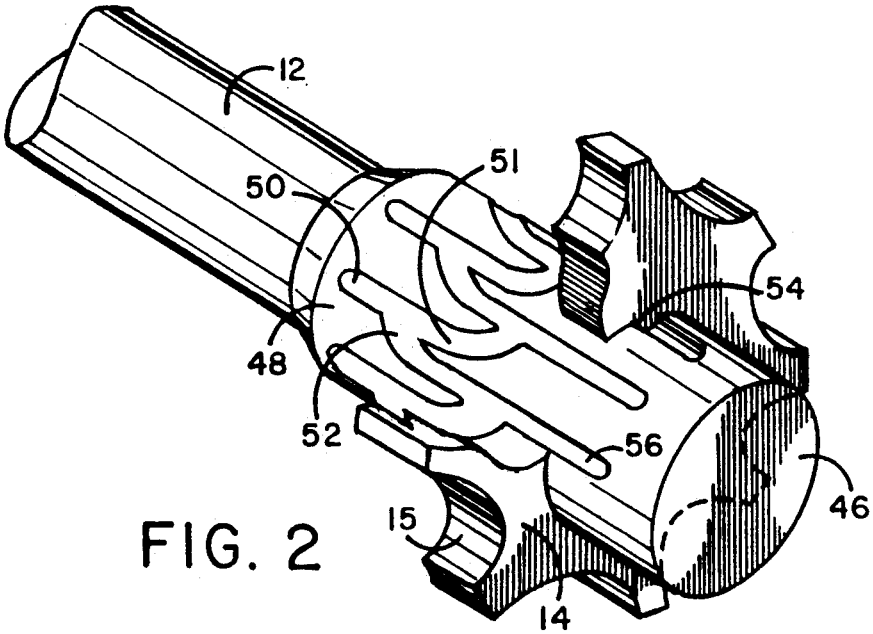
FIG. 2 illustrates a perspective view of the feed sprocket on the barrel extension with a portion of the feed sprocket cut away to show the cam paths and a cam follower.

FIG. 2 illustrates further details of the mechanism of feed sprocket 14 which rotates around barrel 12. The front of barrel extension 48 has a plurality of cam paths 50, 51, 52, and 56 cut therein. The cam paths' action on cam follower 54 on feed sprocket 14 causes feed sprocket 14 to rotate in a clockwise direction in this embodiment when barrel extension 48 moves back and forth within feed sprocket 14. The third cam path 56, being the most rearward, forces cam follower 54 and its attached feed sprocket 14, when the barrel extension moves rearwards, to first enter second cam path 52 and then first cam path 50, causing cam follower 54 to rotate feed sprocket 14. As the barrel moves back and forth, cam follower 54 enters fourth cam path 51 and so on, continuing to rotate feed sprocket 14 as the barrel extension moves approximately 3 inches back and forth during the firing process. Feed sprocket 14 has a ratchet on it, not seen in FIG. 2, which allows only one-way rotation. Since feed sprocket 14 can therefore not rotate backwards, its cam follower will always follow the next advanced cam path to continue clockwise rotation.

Figure 3:
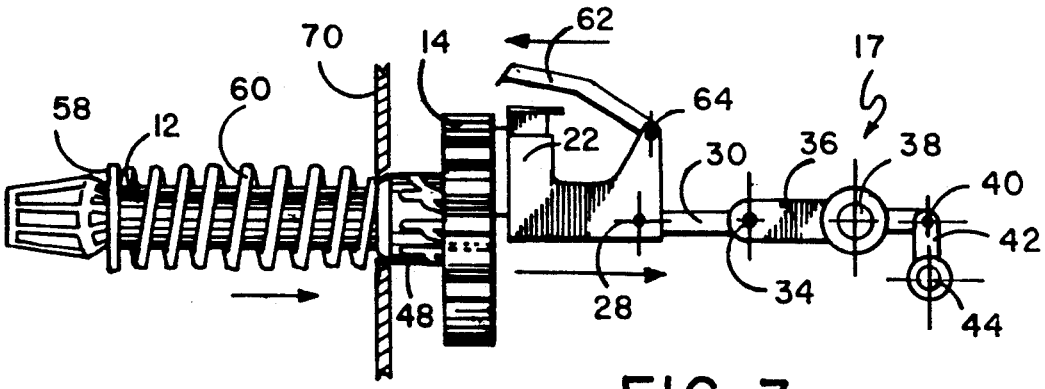
FIG. 3 illustrates a side view of the front of the barrel and the toggle link mechanism with the spring member uncompressed and with the bolt in a firing position.
Figure 4:
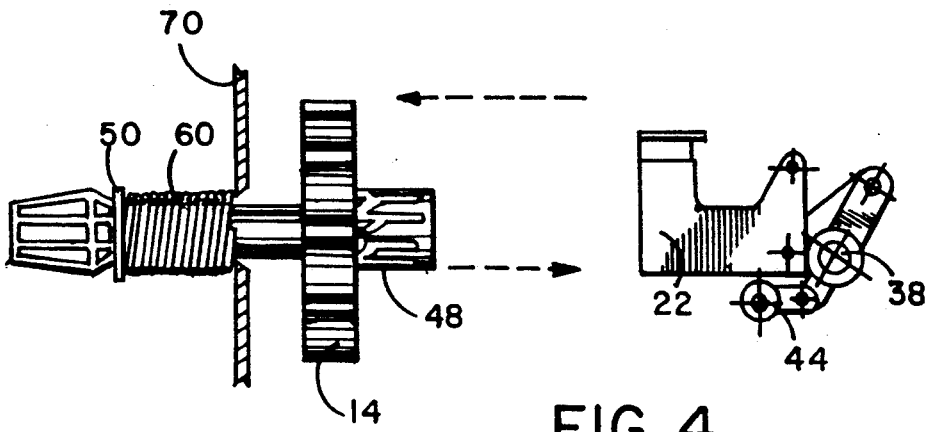
FIG. 4 illustrates a side view of the barrel similar to that of FIG. 3 but after firing of the gun with the bolt in a rearward position and with the barrel extension having been pulled in approximately 3 inches to compress the spring, creating the force needed for counter-recoiling action to pull the bolt back into battery.
Figure 10:
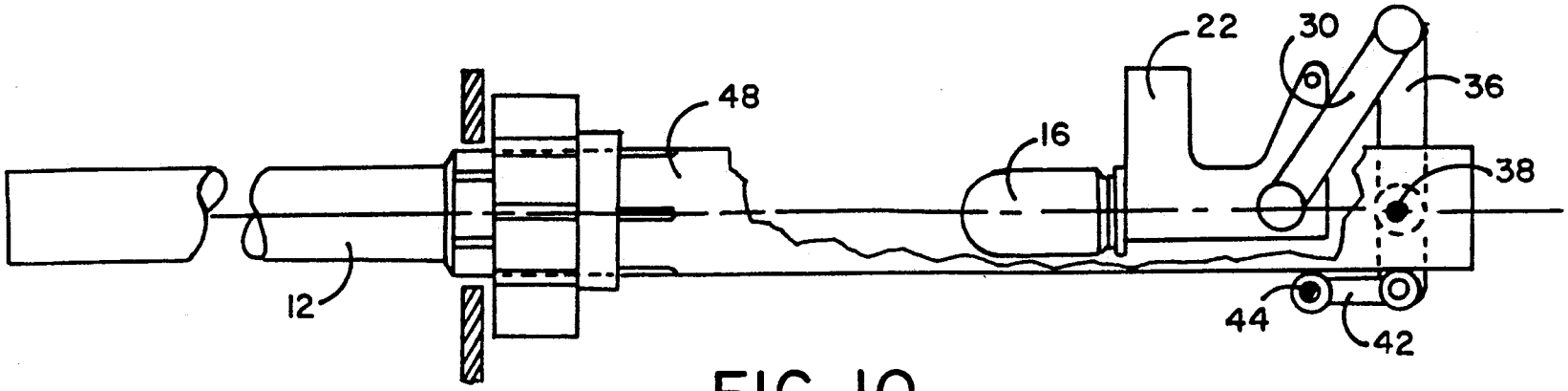
FIG. 10 illustrates a cutaway of the view of FIG. 9 showing the bolt in its rearmost position with the cartridge having been maneuvered downward by the feed lever, aligning it with the chamber ready for firing when the bolt is advanced to battery.

FIG. 3 illustrates a side view of the front of barrel 12 showing barrel extension 48 passing through feed sprocket 14 and toggle link mechanism 17. FIG. 4 illustrates the same view as that of FIG. 3 but with the gun having been fired and barrel extension 48 having moved through feed sprocket 14, rotating it approximately half the distance of one feed sprocket opening to move the next in-line cartridge towards the ready position. In this view can be seen recoil spring stop member 58 which is affixed to barrel. 12. Recoil spring 60 is utilized to cause the forward movement of the mechanism after the firing recoil. In FIG. 3 bolt 22 is in its pre-firing position and when the gun is fired, the gas pressure from the firing pushes the bolt and barrel extension rearward, causing bolt link 30 and main link 36 to pivot upward at second bolt link pivot 34. Main link pivot 38, rotatably attached in the rear 72 of the barrel extension, allows a partial rotation of the main link, as also seen in FIG. 9, as barrel extension 48 moves rearward while at the same time control link 42 is pivotally attached to the rear of main link 36 by control link pivot 40. The bottom of control link 40 is fixed to the stationary receiver, not shown, by stationary pivot 44. While the rearward movement of barrel extension 48 is only approximately 3 inches, the action of bolt link 30 and main link 36 pivoting together accelerates the movement of bolt 22 rearward as seen in FIG. 4, moving bolt 22 a much greater distance than the movement of barrel extension 48 because of the pivoting action of main link 36. This acceleration of the bolt is further increased near the end of the bolt's rearward travel because main link pivot 38 is not centered in main link 36, and the forward portion of main link 36 in front of main link pivot 38 is longer than the portion rearward of the main link pivot, thus causing even greater and faster rearward movement of bolt link 30. In FIGS. 3 and 4 the rear 72 of the barrel extension is not shown for reasons of clarity of illustration but is seen in FIGS. 9 and 10. After firing of the gun, recoil spring 60, having been compressed as seen in FIG. 4, then in its counter-recoil position forces barrel 12 and barrel extension 48 forward. As main link pivot 38 is moved forward, its rear is held by control link 42 which action forces main link 36 to pivot forward, rotating on main link pivot 38 to cause closure pivoting of main link 36 and bolt link 30 to a point where round 16 is positioned in the barrel chamber and ready to fire. Bolt link 30 and main link 36 are then horizontally aligned, as seen in FIG. 3, with bolt 22 then in its battery position.

Figure 5:
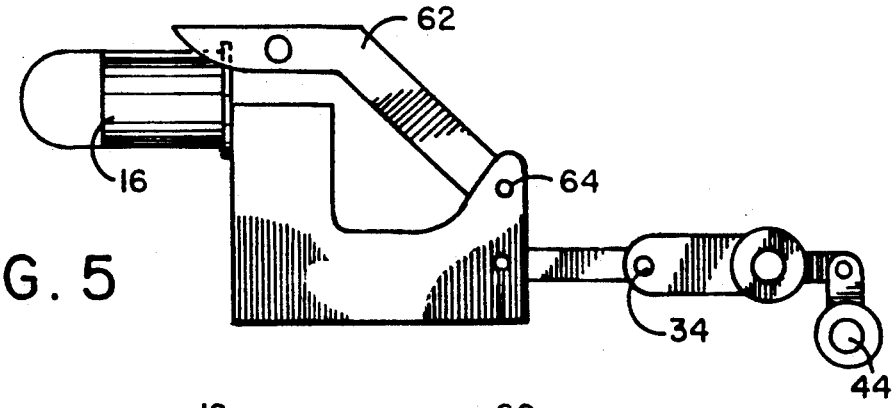
FIG. 5 illustrates a side view of the toggle link mechanism showing the bolt in battery position.
Figure 11:
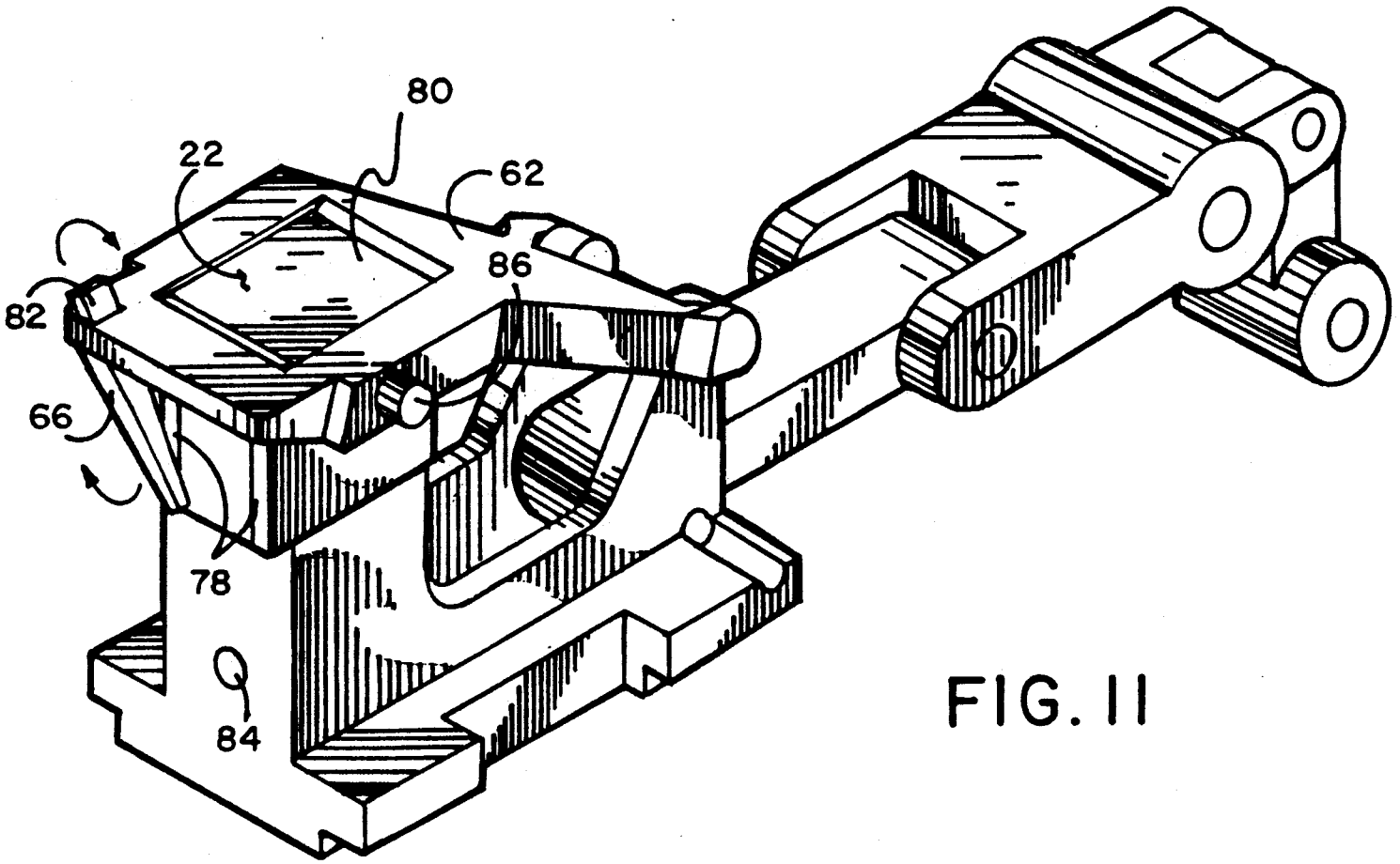
FIG. 11 illustrates a perspective view of the toggle link mechanism showing the feed lever aperture and feed lever arm passing over the top of a portion of the bolt.

FIGS. 5–8 illustrate the sequential firing positions of the toggle link mechanism 17 in relation to feed lever 62 which drives the cartridges into firing position and ejects spent rounds. In FIG. 5 bolt 22 is seen in battery, ready to fire. The cartridge to be fired is not seen as it is in the chamber, also not shown, but bolt extractor 78 on the upper front of bolt 22, as seen in FIG. 11, has latched onto cartridge 16. Extractor 78 has spring-loaded arm catch members disposed on both sides of the rear of the cartridge and latches on to cartridge 16 to pull it out of feed sprocket 14. When the extractor engages the cartridge, the extractor's spring-loaded arms spread apart and when the rim of the rear of the cartridge is within the extractor's arms, they close around it. When the bolt is driven rearward, the extractor pulls the cartridge from the top opening of the feed sprocket rearward, disengaging it from the cartridge belt.

Figure 6:
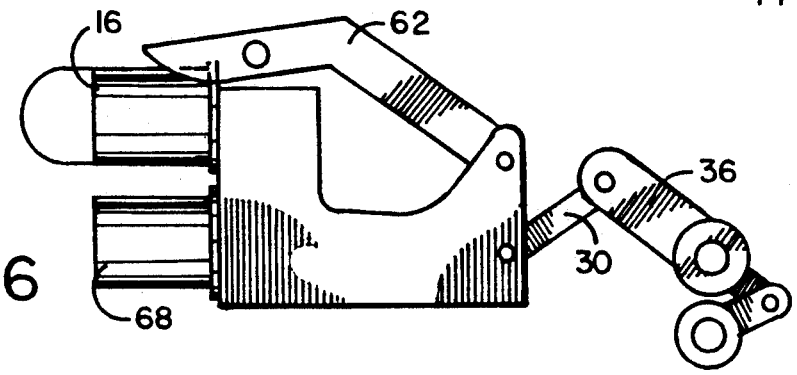
FIG. 6 illustrates a side view of the embodiment of FIG. 5 showing the bolt link pivoting upwards at the second bolt link pivot and the main link pivoting on the main link pivot as the bolt is driven backwards by the gas pressure of the fired cartridge.
Figure 7:
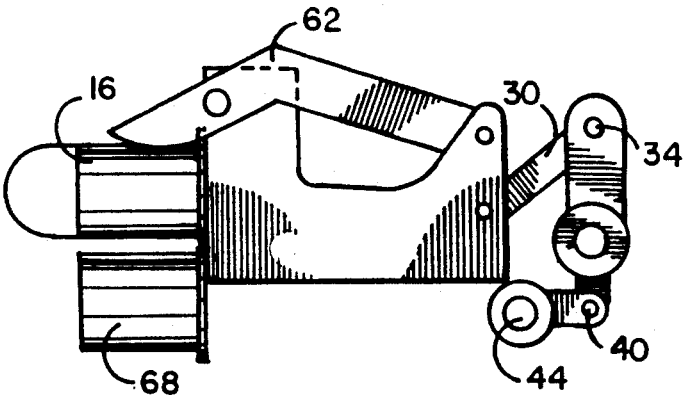
FIG. 7 illustrates a side view of the embodiment of FIG. 5 showing the bolt moved even further to the rear from that shown in FIG. 6 with a new cartridge being advanced downward toward its firing position and the spent cartridge being ejected.
Figure 8:
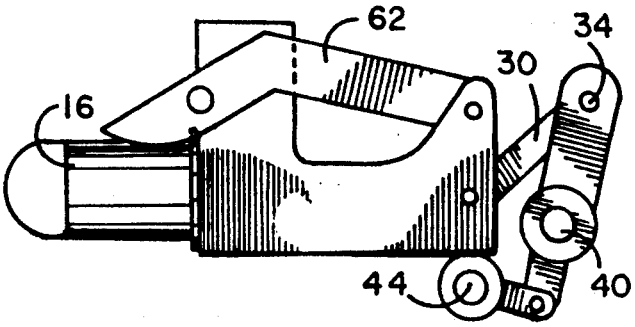
FIG. 8 illustrates a side view of the embodiment of FIG. 5 showing the bolt in its rearmost position with a fresh cartridge now in the firing position ready to be driven forward into the chamber.

In FIG. 6 bolt 22 is shown moved rearward and spent cartridge 68 has been pulled out of chamber 46. At the same time stationary pivot 44 at the bottom of control link 42 causes main link 36 to pivot bolt link 30 upwards at the connection of second bolt link pivot 34. As the bolt moves rearward, as seen in FIG. 7, feed lever 62 starts to drive cartridge 16 downward to the firing position at the bottom of bolt 22 which action in turn pushes spent cartridge 68 out of an aperture in the bottom of the receiver. At the end of the bolt's travel, as seen in FIG. 8, feed lever 62 has pushed cartridge 16 into its firing position near the bottom of bolt 22 in front of firing pin 84, seen in FIG. 11, and the cycle then reverses itself with recoil spring 60 in its compressed position then starting to pull barrel 12 and attached barrel extension 48 forward as the rear of recoil spring 60 presses against forward receiver housing 70, seen in FIG. 9.

FIG. 9 illustrates the gun in battery. FIG. 10 illustrates the gun after firing in which the rear 72 of the barrel extension is seen moved rearward, rotating feed sprocket 14 as discussed above and compressing recoil spring 60, not seen in this view. FIG. 10 shows bolt 22 moving within the rear 72 of barrel extension 48 shown cutaway with main link pivot 38 rotatably held in main link pivot aperture 76 in the rear 72 of the barrel extension. Stationary pivot 44 is rotatably held with the rear 74 of the receiver housing partially shown.

FIG. 11 illustrates a perspective view of toggle link mechanism 17 showing feed lever 62 which moves up and down on bolt 22. Feed lever 62 is attached at the rear of bolt 22 to feed lever support member 26 by feed lever pivot 64. An aperture is formed in the feed lever 62 which aperture allows feed lever 62 to move up and down around the top of bolt 22. Feed lever arm 66 is mounted on the front of feed lever 62 which arm can be pivotally moved laterally, as indicated by the arrows in FIG. 11, being mounted on feed lever arm pivot 82. A portion of feed lever arm 66 extends above feed lever 62 and this extended portion is moved by cam paths formed within the top of the receiver. Feed lever cam 86 extends out of the side of feed lever 62 which runs in cam paths formed in the side of the receiver and is adapted to move feed lever 62 up and down when desired in the firing sequence. Feed lever arm 66 is pivoted laterally by pressure upon its upper portion which extends above the top of feed lever 62 by movement of its upper portion within the cam paths formed on the top of the receiver which directs feed lever arm 66 back and forth so that when bolt 22 is in its firing position in battery and firing pin 84 is aligned with the cartridge to be fired, feed lever arm 66 is pivoted laterally out of the way so that extractor 78, seen in this view, can grasp the next cartridge. As toggle link mechanism 17 moves bolt 22 to the rear, feed lever 62 moves down from the movement of feed lever cam 86 within the cam paths positioned in the side of the receiver. As bolt 22 moves rearwardly, feed lever 62 then moves downward, forcing the newly picked up cartridge within the extractor to move down upon spent cartridge 68, seen in FIGS. 6 and 7, pushing the spent cartridge out through an opening in the bottom of the receiver while at the same time pushing the newly picked up cartridge into position in front of firing pin 84 so that the new cartridge can then be driven into chamber 46 for firing when toggle link mechanism 17 advances the bolt to battery. Stripper arm 66, seen in FIG. 11, is utilized after the last round in the ammo belt as there is no new round to be fed down the bolt face to push the spent round off the bolt. Stripper arm 66 is mounted on stripper pivot 82 and rotates inward if no round is picked up from the feed sprocket and then pushes the spent case off the bolt.

Although the present invention has been described with reference to particular embodiments, it will be apparent to those skilled in the art that variations and modifications can be substituted therefor without departing from the principles and spirit of the invention.

We claim:

1. A grenade launcher for the firing of a plurality of cartridges in sequence, comprising:

a barrel having a chamber with a breach defined therein;

a bolt having cartridge firing means;

a receiver carrying said barrel and said bolt;

a rotary feed mechanism having an aperture defined therein with said barrel passing through said aperture, said feed mechanism adapted to receive said cartridges in sequence while rotating around said barrel;

an alignable toggle link mechanism including a bolt link having a first and second end a main link having a first and second end, said second end of said bolt link pivotally attached to said first end of said main link, said bolt link and main link having a first aligned position where said bolt link and main link are aligned with one another and an unaligned position where said bolt link and main link have pivoted at an angled to one another and are in the unaligned position where said first end of said bolt link and second end of said main link are first end and second ends of said toggle link mechanism, respectively, said toggle link mechanism attached at said first end to said bolt and attached at said second end to said receiver, said toggle link mechanism in a first mode to move said bolt into battery against the breach of said chamber in said barrel and upon firing of a cartridge, said bolt being moved away from said chamber causing said toggle link mechanism in a second mode to become unaligned;

means on said bolt to pick up a cartridge from said rotary feed mechanism;

means to move said cartridge into position aligned with the breach of the chamber of said barrel;

means to simultaneously eject any spent cartridge shells out of said receiver; and means to pull said toggle link mechanism to become realigned into said first mode to move said bolt back into said battery, pushing said next sequential cartridge into said chamber for firing.

2. A grenade launcher for the firing of a plurality of cartridges in sequence, comprising:

a substantially round, rotatable feed sprocket member having an aperture defined in the center thereof and an outer periphery, said feed sprocket member receiving said cartridges in sequence around its periphery;

a barrel having a front and rear, said barrel orthogonally disposed through said aperture in the center of said feed sprocket, said barrel having an barrel extension having a front and rear, said barrel extension extending from the rear of said barrel and a firing chamber disposed in the front of said barrel extension, said barrel movable in said feed sprocket aperture;

means to rotate said feed sprocket member as said barrel moves in said aperture in said feed sprocket;

a bolt member having a front and rear, said front having a face, said bolt slidably disposed in said barrel extension;

means to fire said cartridge;

a receiver in which said barrel is movably retained;

a toggle mechanism, having front and rear ends, disposed in said barrel extension, said toggle mechanism affixed at its rear end to said receiver and at its front end to the rear of said bolt member, said toggle mechanism movable to be in an advanced or retracted position relative to said firing chamber;

means on the face of said bolt member to pick up a cartridge from said feed sprocket when said toggle mechanism is in said advanced position in said barrel extension;

means for said toggle mechanism to pull said bolt member away from said feed sprocket while moving to said retracted position when a cartridge is fired;

means to push said cartridge down said face of said bolt member into said barrel extension;

means to pull said barrel and barrel extension forward in said receiver in counter recoil after firing; and means for said toggle mechanism when moving to said advanced position to push a cartridge into battery in the firing chamber of said barrel extension.

3. A grenade launcher for the firing of a plurality of cartridges in sequence, comprising:

a barrel having a front end and a rear end;

a barrel extension disposed at the rear end of said barrel, said barrel extension having a top, a bottom, sides, a front end, and a rear end;

a plurality of cam paths, each having a front and a rear, said cam paths defined around the periphery of said front end of said barrel extension;

a substantially round feed sprocket having an outer periphery and a central axis, said feed sprocket having a plurality of openings defined in its outer periphery with one of said openings disposed at an uppermost position, each opening to receive one cartridge, said feed sprocket having a substantially round aperture defined at said central axis through which said round aperture the front end of said barrel extension is positioned to move reciprocally within said round aperture;

a cam follower positioned on said feed sprocket, said cam follower engaging into said cam paths on the front end of said barrel extension, said barrel extension reciprocally movable within said feed sprocket for said cam paths to move said cam follower to rotate said feed sprocket to advance one of said openings in said feed sprocket containing a cartridge to said uppermost position of said feed sprocket during forward and rearward movement of said barrel extension relative to said feed sprocket;

a stationary receiver having a front and a rear, said front of said receiver disposed in front of said feed sprocket, said barrel and barrel extension movable as a unit within said receiver;

a spring stop member disposed on said barrel;

a recoil spring member disposed around said barrel between said spring stop member and the front of said receiver;

a chamber having a front and a rear, said chamber defined in said barrel extension, said chamber positioned to the rear of said cam paths in said barrel extension, said chamber aligned with said barrel, said barrel extension having an elongated opening defined in its top to the rear of said chamber;

a bolt member having a front, an upper front portion, a lower front portion, and a rear, said bolt member slideably positioned in said elongated opening of said barrel extension behind said chamber, said bolt member including a firing pin positioned in said lower front portion facing said chamber, said bolt member having cartridge extractor means positioned on its front above said firing pin, said bolt member aligned with said chamber and having its extractor means aligned with the uppermost position of said feed sprocket;

a bolt link having a front and a rear, said front of said bolt link pivotally attached to the rear of said bolt member;

a main link having a front and a rear, said front of said main link pivotally attached to the rear of said bolt link;

a main link pivot positioned in said main link, said main link pivot pivotally engaged in the sides of the rear end of said barrel extension;

a control link having a front and a rear, said front of said control link pivotally attached at the rear of said main link, and said rear of said control link pivotally attached to said rear of said stationary receiver;

means for said cartridge extractor means to attach to said cartridge in said uppermost position on said feed sprocket;

means to move said bolt member rearward in said barrel extension carrying said extracted cartridge from said uppermost position of said feed sprocket;

means for driving said extracted cartridge downward in front of said bolt to an area in front of said firing pin to be aligned with said chamber;

means to drive simultaneously said bolt member into battery and said cartridge into said chamber; and

4. The grenade launcher of claim 3 wherein said bolt member at its rear includes an upwardly extending feed lever support member; said means for driving said cartridge downward includes a feed lever member having a front and a rear, said feed lever member pivotally mounted at its rear on said feed lever support member, said feed lever adapted to individually contact and push said cartridges downward on a previously spent cartridge to expel said previously spent cartridge from said grenade launcher.

5. The grenade launcher of claim 4 wherein said main link pivot is positioned toward the rear of said main link and when said barrel extension is moved rearward during firing by the force of gas released by said fired cartridge against said bolt member and said bolt member's interconnection to said barrel extension by said main link pivot, said main link simultaneously pivots upwards as the pivoting rear of said control link is held downward by said control link due to said control link's pivotal attachment to said stationary receiver, causing said main link to pivot on said main link pivot upwards at its front, raising the rear of said bolt link and pulling said bolt member rearward within said elongated opening in said barrel extension a distance greater than the distance traveled by said barrel extension and wherein said spring member, being compressed by the rearward movement of said barrel forcing said spring stop member against the front of said recoil spring member and compressing said recoil spring member against the front of said receiver, urges forward in counter recoil, forcing said recoil spring stop member forward, pulling said barrel and barrel extension forward and moving said bolt member forward into battery, chambering said cartridge then in front of said firing pin by the action of said main link then pivoting downward at its pivotal interconnection with said bolt link while said feed sprocket rotates approximately one opening by the action of said cam paths on said cam follower on said feed sprocket and moving the next successive cartridge into position to be then grasped by said cartridge extractor means on said upper front portion of said bolt member.

* * * * *